US010988962B2

(12) United States Patent
Park et al.

(10) Patent No.: US 10,988,962 B2
(45) Date of Patent: Apr. 27, 2021

(54) RETRACTABLE OUTSIDE HANDLE ASSEMBLY FOR VEHICLE

(71) Applicants: Hyundai Motor Company, Seoul (KR); Kia Motors Corporation, Seoul (KR)

(72) Inventors: Hoo Sang Park, Hwaseong-si (KR); Sang Hoon Gweon, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 527 days.

(21) Appl. No.: 15/969,220

(22) Filed: May 2, 2018

(65) Prior Publication Data

US 2019/0178012 A1 Jun. 13, 2019

(30) Foreign Application Priority Data

Dec. 8, 2017 (KR) ..... 10-2017-0168640

(51) Int. Cl.
*E05B 85/10* (2014.01)
*E05B 81/76* (2014.01)
*E05B 81/06* (2014.01)

(52) U.S. Cl.
CPC ..... *E05B 85/103* (2013.01); *E05B 85/107* (2013.01); *E05B 81/06* (2013.01); *E05B 81/76* (2013.01); *E05Y 2900/531* (2013.01)

(58) Field of Classification Search
CPC ..... Y10T 292/57; Y10T 70/5761; Y10T 70/5889; Y10T 16/458; Y10T 16/473; Y10T 16/44; E05B 85/107; E05B 5/003; E05B 5/006; E05B 79/06; E05B 5/00; E05B 85/103; E05B 81/06; E05B 81/76; Y10S 292/31; E05C 1/145; E05Y 2900/531
See application file for complete search history.

(56) References Cited

U.S. PATENT DOCUMENTS 5,123,687 A * 6/1992 Pfeiffer ..... E05B 1/0092 292/336.3
8,443,553 B1 * 5/2013 Polewarczyk ..... E05B 85/103 49/503
2003/0019261 A1 * 1/2003 Wittwer ..... E05B 81/76 70/257
2003/0111848 A1 * 6/2003 Hansen ..... E05B 1/0092 292/336.3
2009/0079233 A1 * 3/2009 Hidaka ..... B60N 3/023 296/210

(Continued)

*Primary Examiner* — Mark A Williams
(74) *Attorney, Agent, or Firm* — Morgan, Lewis & Bockius LLP

(57) ABSTRACT

A retractable outside handle assembly for a vehicle include a retractable outside door handle protruding outward in a width direction of the vehicle from a door outside panel forming a door of the vehicle or being housed in an opening portion formed in the door outside panel and a base assembly with which retractable outside door handle is rotatably assembled wherein the base assembly includes two first and second door outside handle internal bases which are relatively movable with respect to each other, and a door outside handle external base housing first and second door outside handle internal bases, improving assemble workability and reducing weight and cost.

9 Claims, 7 Drawing Sheets

(56) References Cited

U.S. PATENT DOCUMENTS

| | | | | |
|---|---|---|---|---|
| 2011/0148575 | A1* | 6/2011 | Sobecki | E05B 81/62<br>340/5.64 |
| 2013/0076047 | A1* | 3/2013 | Wheeler | E05B 5/006<br>292/336.3 |
| 2013/0076048 | A1* | 3/2013 | Aerts | G07C 9/00944<br>292/336.3 |
| 2013/0127185 | A1* | 5/2013 | Lang | E05B 85/103<br>292/336.3 |
| 2013/0241215 | A1* | 9/2013 | Halliwell | E05B 85/107<br>292/336.3 |
| 2014/0047773 | A1* | 2/2014 | Johnsrud | E05B 85/107<br>49/460 |
| 2015/0233154 | A1* | 8/2015 | Smart | E05B 81/90<br>70/237 |
| 2016/0298366 | A1* | 10/2016 | Och | E05B 85/12 |

* cited by examiner

RETRACTABLE OUTSIDE HANDLE ASSEMBLY FOR VEHICLE

CROSS-REFERENCE TO RELATED APPLICATION

The present application claims priority to Korean Patent Application No. 10-2017-0168640 filed on Dec. 8, 2017, the entire contents of which is incorporated herein for all purposes by this reference.

BACKGROUND OF THE INVENTION

Field of the Invention

The present invention relates to a retractable outside handle assembly for a vehicle, and, more particularly, a retractable outside handle assembly for a vehicle of which an outside door handle may be received in a door outside panel and protrude to the outside of door external panel.

Description of Related Art

Generally, a vehicle has been provided with a passenger compartment of a predetermined size to which a driver or an accompanying passenger can ride, and a door for opening or closing the passenger compartment has been provided.

For the passenger to open or close the door for opening or closing the passenger compartment, an inside door handle has been provided at an inside surface of the door facing the passenger compartment and an outside door handle has been provided at an outside surface of the door facing the outside of the passenger compartment.

Each door handle is connected to a door latch for fixing the door to a vehicle body so that the door may be opened while the door latch is released by the operation of the door handles.

The outside door handle has been typically pivotably mounted on a door external panel. Also, the outside door handle has been disposed on the door outside panel to protrude outward along the width direction of the vehicle so that the passenger may easily grasp it.

As described above, when the outside door handle is disposed to protrude outward along the width direction of the vehicle, the convenience of operation of the occupant is improved, but the appearance of the vehicle may be deteriorated due to the protruded outside door handle, noise may be induced and the driving performance due to driving resistance may be deteriorated.

In recent years, to solve this problem, a retractable outside handle assembly of which the outside door handle protrudes from the door outside panel along the width direction of the vehicle or housed inside the receiving hole formed in the door outside panel when a motor is driven, is being developed.

The conventional retractable outside door handle assembly includes an outside door handle which protrudes from the door outside panel outwardly or housed inside the receiving hole formed in the door outside panel via a linkage operated by a motor, a door lock mechanism including an operable key cylinder for locking or releasing the door to a vehicle and a door latch mechanism for directly locking or releasing the door to the vehicle body.

However, when assembling the above conventional retractable outside door handle assembly, the door lock mechanism may be connected to the door handle assembly first so that the assembling work of the door latch mechanism the outside door handle assembly becomes difficult. Due to the provided configuration, the door latch mechanism may be modularized and then assembled with the outside door handle assembly so that a fixing bracket is required for assembling the door latch mechanism and the outside door handle assembly, deteriorating the assembling workability and increasing weight and cost.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a retractable outside handle assembly for a vehicle configured for improving mounting workability of a door lock mechanism and reducing weight and cost by allowing an outside door handle to be assembled to the base from the outside of the outside door.

A retractable outside handle assembly for a vehicle according to an exemplary embodiment of the present invention may include direction of the vehicle from a door outside panel forming a door of the vehicle or being housed in an opening portion formed in the door external panel; and a base assembly with which retractable outside door handle is rotatably assembled. The base assembly may include two first and second door outside handle internal bases which are relatively movable with respect to each other; and a door outside handle external base housing first and second door outside handle internal bases.

The two first and second door outside handle internal bases may be movably disposed with respect to the door outside handle external base.

The first door external side handle internal base may be disposed forward of the second door external side handle internal base along the longitudinal direction of the vehicle; and the first door outside handle internal base and the second door outside handle internal base may be connected to each other through a screw.

The first door outside handle internal base may include a receiving groove communicating with the opening portion; and a latching groove formed to be opened toward the receiving groove on an upper wall forming the receiving groove.

The second door outside handle internal base may include a receiving groove communicating with the opening portion and the receiving groove of the first door outside handle internal base; and a protruding jaw formed on a bottom wall forming the receiving groove to be protruded outward along the width direction of the vehicle.

A latching jaw may be disposed at the protruding jaw to be elastically supported via a spring toward outside of the width direction of the vehicle.

The door outside handle may include an external surface along the width direction of the vehicle; two first and second bridges protruding from the external surface toward the internal to the width direction of the vehicle and disposed at predetermined intervals in the front and rear along the longitudinal direction of the vehicle; and a third bridge formed at an end portion of the first bridge in the longitudinal direction of the vehicle.

A latching jaw inserted into and caught by the latching groove of the first door outside handle internal base may be formed at a front end portion of the third bridge; and a latching groove into which the latching jaw of the second door outside handle internal base is inserted and caught by, may be formed at a rear end portion of the third bridge.

According to a retractable outside handle assembly for a vehicle according to an exemplary embodiment of the present invention, since the external door panel is assembled to the base assembly by inserting the external side door handle into the opening portion of the door outside panel from the outside thereof along the width direction of the vehicle in a state where the base assembly is assembled to the internal to the door outside panel toward the internal to the passenger compartment, it is possible to insert the door lock mechanism first through the opening and assemble it with the base assembly before the external side door handle and the base assembly are assembled together.

Therefore, an assemble workability of a door lock mechanism may be improved as well as the coating damage of the door panel may be prevented during the assemble process and the fixing bracket for assemble between the conventional door latch mechanism and the outside door handle is unnecessary, reducing weight and cost.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
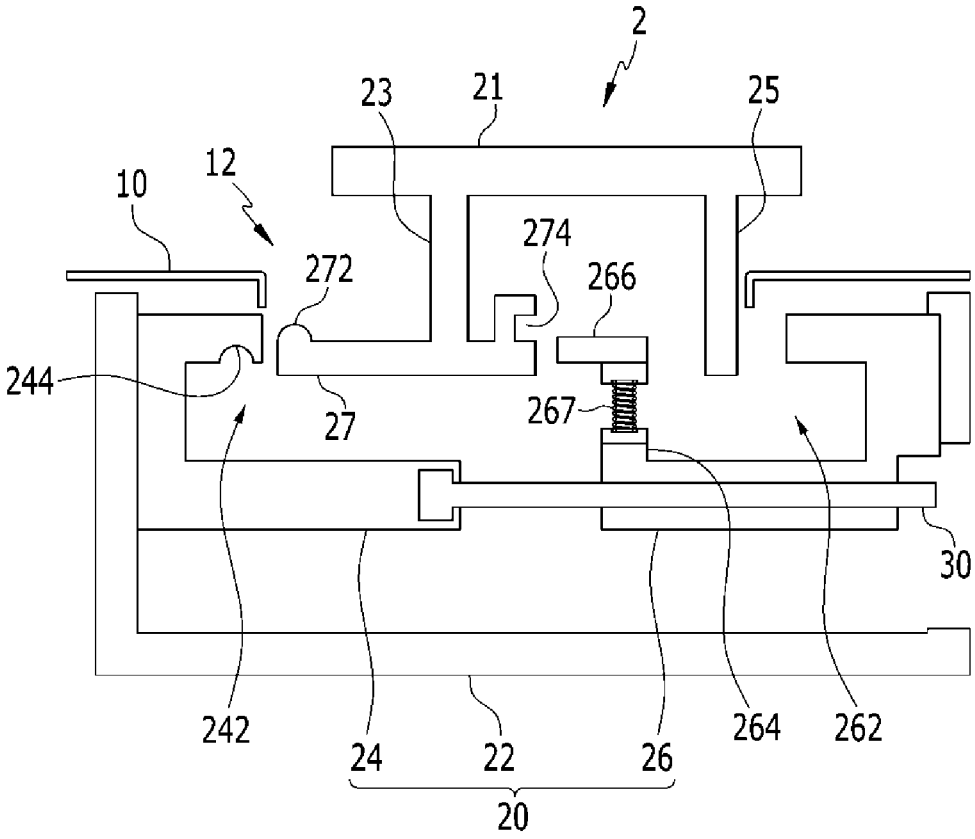
FIG. 1 is a cross-sectional view in a state that a retractable outside door handle assembly according to an exemplary embodiment of the present invention is mounted on door external panel.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the contrary, the invention(s) is/are intended to cover not only the exemplary embodiments of the present invention, but also various alternatives, modifications, equivalents and other embodiments, which may be included within the spirit and scope of the invention as defined by the appended claims.

Exemplary embodiments of the present application will be described more fully hereinafter with reference to the accompanying drawings, in which exemplary embodiments of the present invention are shown.

Referring to FIG. 1, a retractable outside handle assembly for a vehicle according to an exemplary embodiment of the present invention may include a door outside handle 2 inserted into an opening portion 12 formed at a door outside panel 10 and assembled with the door outside panel 10.

A door outside handle base assembly 20, at which the door outside handle 2 is disposed to be moved and pivoted, may be mounted at the internal to the door outside panel 10 facing a passenger compartment.

The door outside handle base assembly 20 may include a door outside handle external base 22 disposed at the internal to the door outside panel 10 facing the passenger compartment and two first and second door outside handle internal bases 24, 26 disposed in the space formed by a door outside handle external base 22 and the door outside panel 10 and disposed to be moved with respect to the door outside handle external base 22 through a driving device and a linkage not shown.

The first door outside handle internal base 24 may be disposed forward of the second door outside handle internal base 26 along the longitudinal direction of a vehicle and the first door outside handle internal base 24 and the second door outside handle internal base 26 may be connected to each other through a screw 30 such that the second door outside handle internal base 26 may move toward or away from the first door outside handle internal base 24 by the rotation of the screw 30.

The first door outside handle internal base 24 may include a receiving groove 242 communicating with the opening portion 12 and a latching groove 244 formed to be opened toward the receiving groove 242 on an upper wall forming the receiving groove 242.

The second door outside handle internal base 26 may include a receiving groove 262 communicate with the opening portion 12 and the receiving groove 242 and a protruding jaw 264 protruded outward along the width direction of a vehicle on a bottom wall forming the receiving groove 262.

A latching jaw 266 may be disposed at the protruding jaw 264 toward the outside of the width direction of a vehicle to be elastically supported via a spring 267 as an elastic supporting device.

The door outside handle 2 may include an external surface 21 facing the outside of the width direction of a vehicle and two first and second bridges 23, 25 protruding toward the internal to the width direction of a vehicle and disposed at predetermined intervals back and forth along the longitudinal direction of a vehicle.

The first bridge 23 may be disposed forward along the longitudinal direction of a vehicle than the second bridge 25 and a third bridge 27 extending along the longitudinal direction of a vehicle may be integrally formed at an end portion of the first bridge 23.

The front end portion of the third bridge 27 may be provided with a latching jaw 272 which is inserted into the latching groove 244 at the time of assemble and the rear end portion of the third bridge 27 may be provided with a latching groove 274 into which the latching jaw 266 is inserted and caught thereto.

Figure 2:
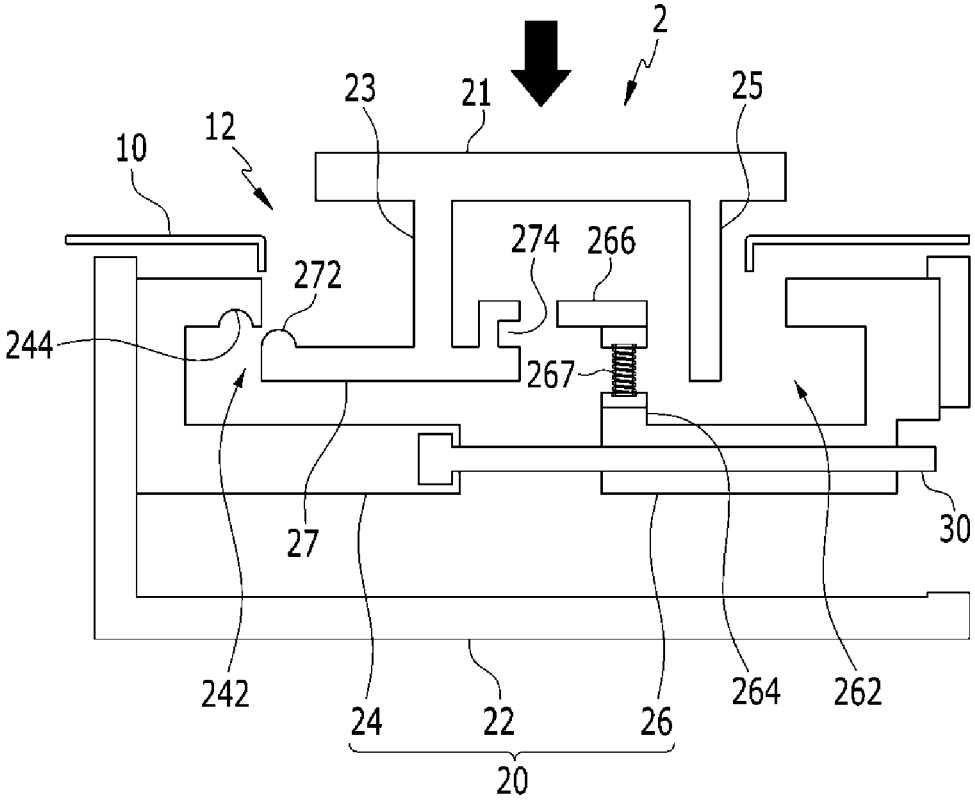
FIG. 2, FIG. 3 and FIG. 4 are cross-sectional views explaining assemble process of a retractable outside door handle assembly according to an exemplary embodiment of the present invention.

According to the assemble process of a retractable outside handle assembly for a vehicle according to an exemplary embodiment of the present invention, as shown in FIG. 2, at first, the door outside handle 2 is inserted through the opening portion 12 of the door outside panel 10 in a state that the base assembly 20 is mounted at the door outside panel 10.

Figure 3:
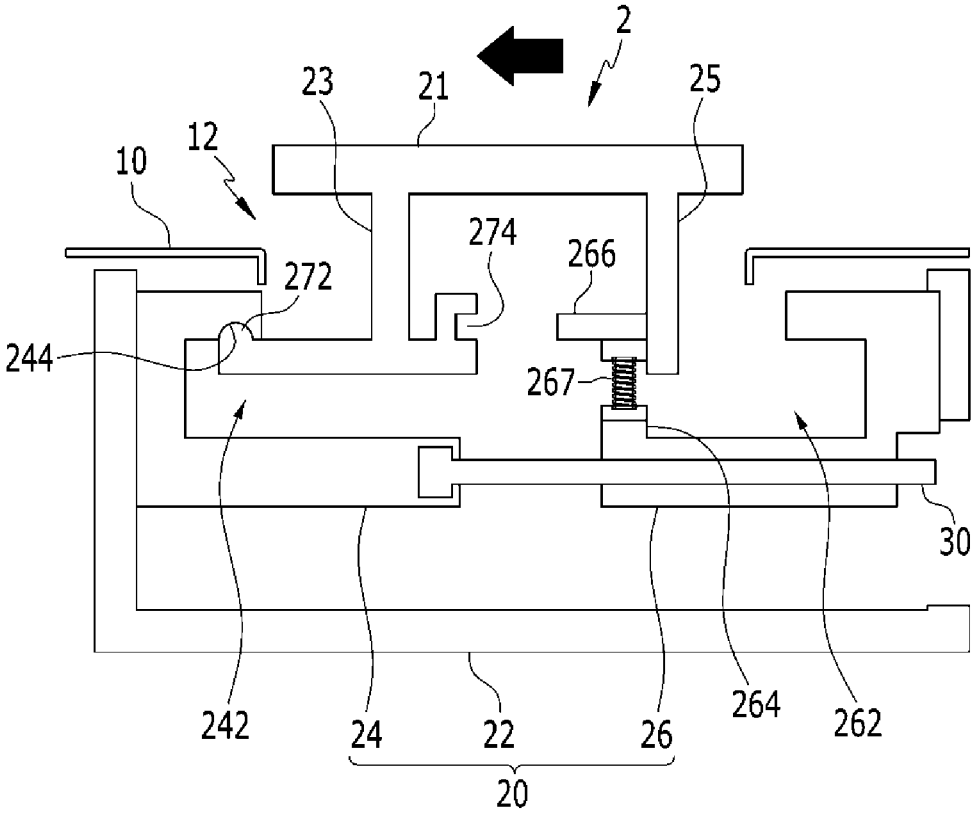
Figure 4:
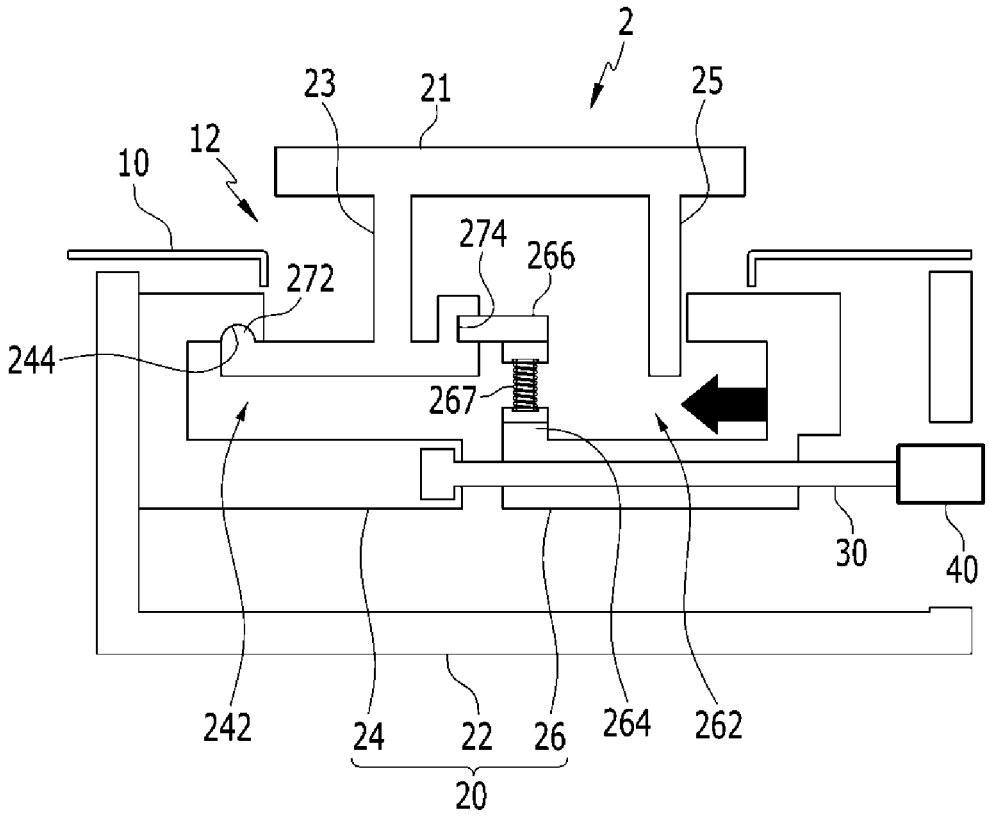

Next, as shown in FIG. 3, the door outside handle 2 is pushed forward along the longitudinal direction of a vehicle so that the latching jaw 272 of the door outside handle 2 may be inserted into and caught by the latching groove 244 of the first door outside handle internal base 24.

As described above, when the latching jaw 272 of the door outside handle 2 is inserted into and caught by the latching groove 244 of the first door outside handle internal base 24, the positions of the latching groove 274 and the latching jaw 266 of the door outside handle 2 is automatically disposed.

In the present state, if the screw 30 is rotated via tools 40 such as a screwdriver, the second door outside handle internal base 26 is moved forward along the longitudinal direction of a vehicle by the rotation of the screw 30 so that the latching jaw 266 is inserted into caught to the latching groove 274. As a result, the door outside handle 2 is supported by the first and second door outside handle internal bases 24 and 26.

Figure 5:
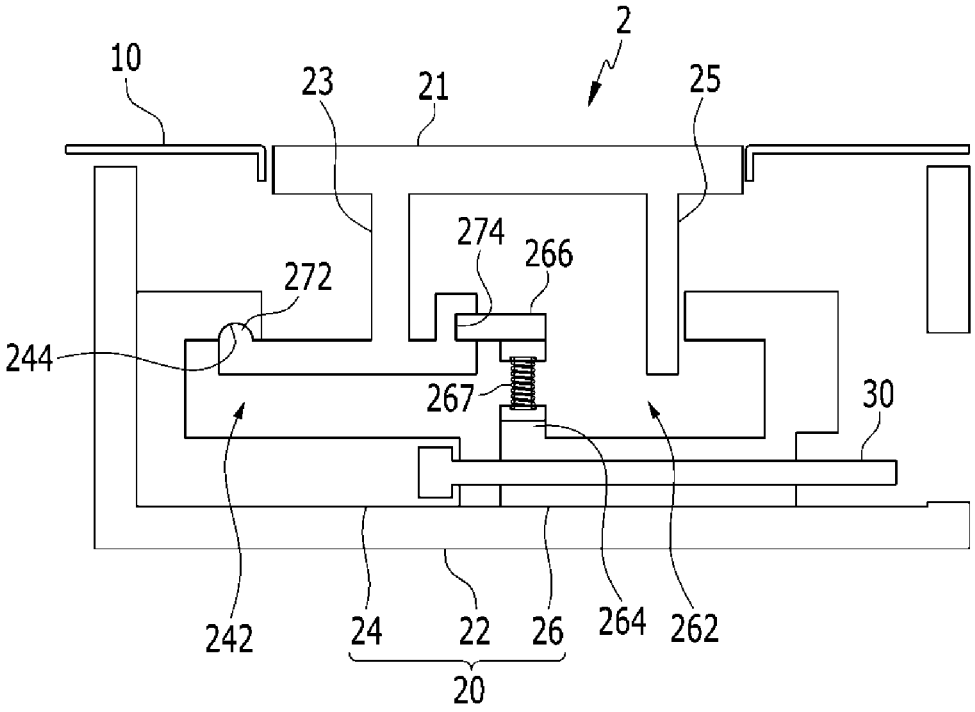
FIG. 5 is a cross-sectional view in a state that a retractable outside door handle assembly according to an exemplary embodiment of the present invention is housed in an opening portion of a door outside panel in a door locked state.

FIG. 5 shows the state that the door outside handle 2 completely assembled as described above is inserted into the opening portion of the door outside panel 10, that is, the door of the vehicle is locked.

Figure 6:
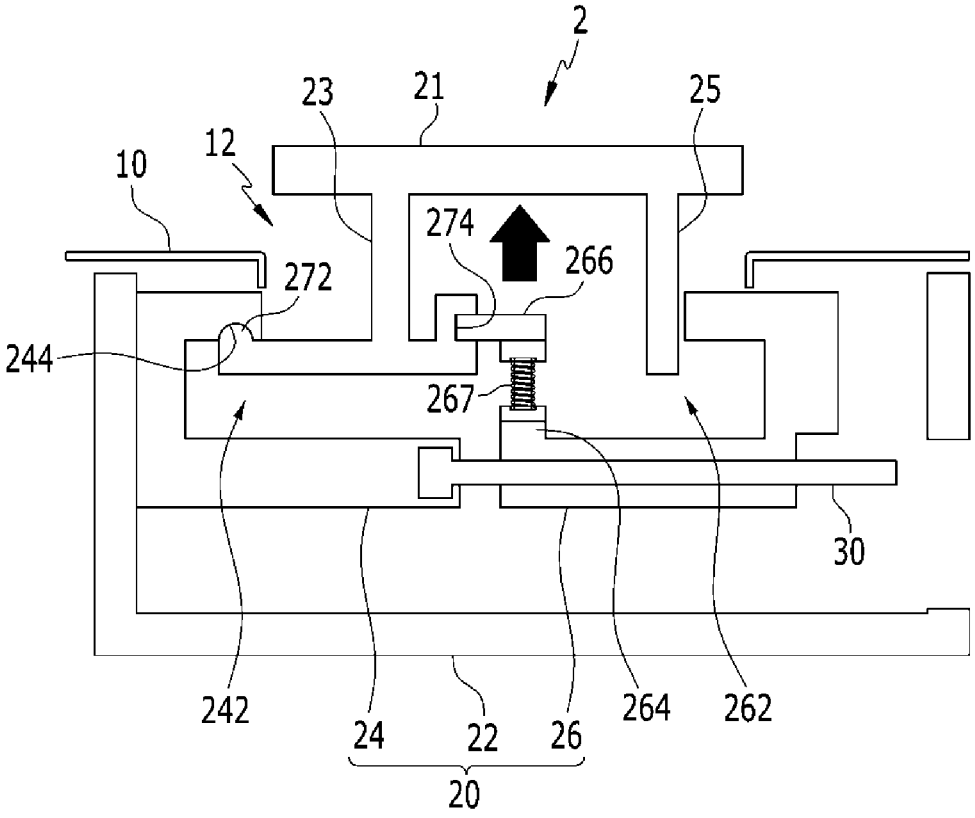
FIG. 6 is a cross-sectional view in a state that a retractable outside door handle assembly according to an exemplary embodiment of the present invention is popped up outside a door external panel.
Figure 7:
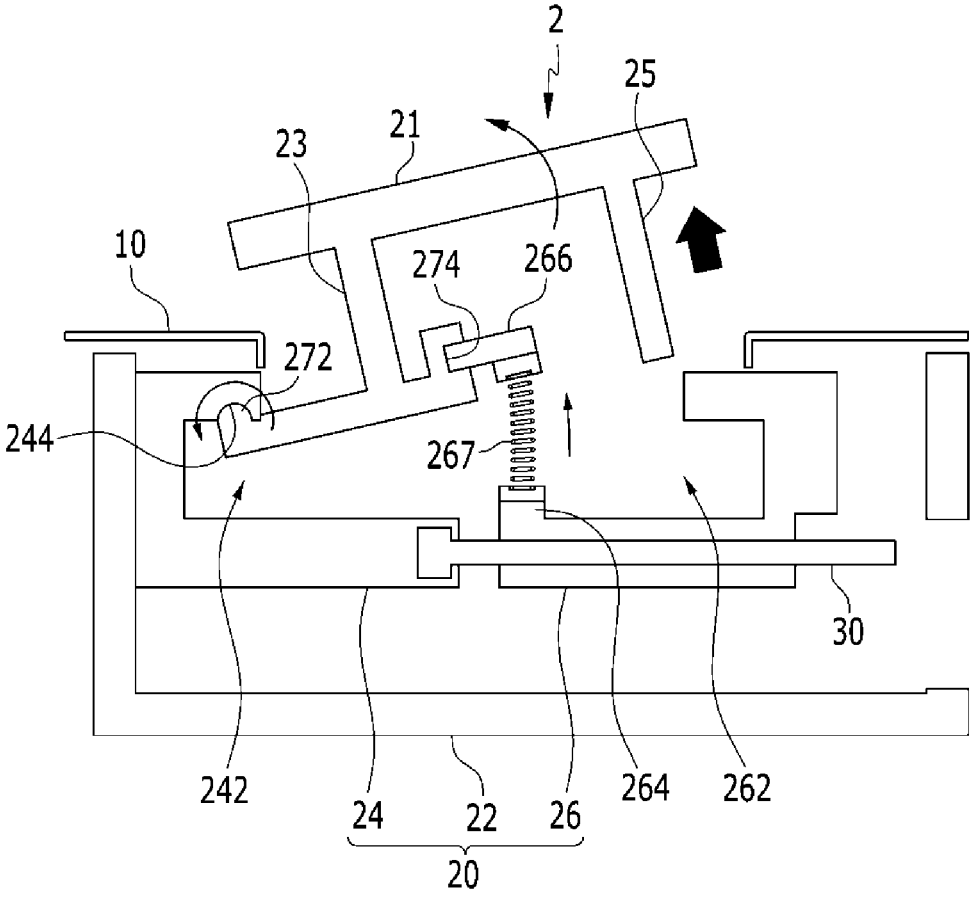
FIG. 7 is a cross-sectional view in a state that a retractable outside door handle assembly according to an exemplary embodiment of the present invention is pivoted outward in the width direction of a vehicle by user's pulling operation.

When a passenger carries the smart key and approaches the vehicle, manipulates a remote control key, or presses the rear portion of the door outside handle 2 along the longitudinal direction of the vehicle, by the operation of a drive motor and a link mechanism connected thereto, as shown in FIG. 6, the door outside handle 2 protrudes to the outside of the door outside panel 10 along the width direction of a vehicle while being supported on the first and second door outside handle internal bases 24 and 26.

As described above, when a passenger pulls the door outside handle 2 by hand in a state that the door outside handle 2 protrudes outward in the width direction of the vehicle, the door outside handle 2 is pivoted outward in the width direction of a vehicle with the latching grooves 244 and latching jaw 272 as hinge points and a unlocked cable or unloading cable connected to the door outside handle 2 is pulled by the door outside handle 2 to open the door.

When a passenger releases the door outside handle 2, the door outside handle 2 is returned to its unturned original position by the elastic restoring force of spring 267 extending by a door outside handle 2.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A retractable outside handle assembly for a vehicle, the retractable outside handle assembly comprising:

a door outside panel forming a door of the vehicle and provided with an opening portion formed therein;

a retractable door outside handle which is movable in a width direction of the vehicle through the opening portion so that the door outside handle protrudes outward in the width direction of the vehicle from the door outside panel or which is housed in the opening portion; and a base assembly with which an end of the retractable door outside handle is rotatably assembled, wherein the door outside handle is rotatable with respect to the end of the door outside handle in a state that the door outside handle protrudes outward in the width direction of the vehicle from the door outside panel;

wherein the base assembly includes:

first and second door outside handle internal bases; and a screw connecting the first and second door outside handle internal bases, wherein the first and second door outside handle internal bases are relatively movable rectilinearly with respect to each other through rotation of the screw, and wherein the base assembly is configured for applying force to the door outside handle in the width direction.

2. The retractable outside handle assembly of claim 1, wherein one of the first and second door outside handle internal bases is movably disposed with respect to a door outside handle external base.

3. The retractable outside handle assembly of claim 1, wherein the first door outside handle internal base is disposed in front of the second door outside handle internal base in a forward direction of the vehicle along a longitudinal direction of the vehicle.

4. The retractable outside handle assembly of claim 1, wherein the first door outside handle internal base includes:

a first receiving groove fluidically communicating with the opening portion; and a first latching groove formed to be open toward the first receiving groove on an upper wall forming the first receiving groove.

5. The retractable outside handle assembly of claim 4, wherein the second door outside handle internal base includes:

a second receiving groove fluidically communicating with the opening portion and the first receiving groove of the first door outside handle internal base; and a protruding jaw formed on a bottom wall of the second door outside handle internal base and to be protruded outward along the width direction of the vehicle and forming the second receiving groove of the second door outside handle internal base.

6. The retractable outside handle assembly of claim 5, wherein a latching jaw is disposed at the protruding jaw to be elastically supported via an elastic member toward outside of the width direction of the vehicle.

7. The retractable outside handle assembly of claim 6, wherein the door outside handle includes:

an external surface along the width direction of the vehicle;

first and second bridges protruding from the external surface toward the internal of the door outside handle to the width direction of the vehicle and disposed at predetermined intervals in front and rear direction along a longitudinal direction of the vehicle; and a third bridge formed at an end portion of the first bridge in the longitudinal direction of the vehicle.

8. The retractable outside handle assembly of claim 7, wherein a latching jaw inserted into and caught by the first latching groove of the first door outside handle internal base is formed at a front end portion of the third bridge; and wherein a second latching groove into which the latching jaw of the second door outside handle internal base is configured to be inserted and caught by is formed at a rear end portion of the third bridge.

9. The retractable outside handle assembly of claim 8, wherein the second latching groove into which the latching jaw of the second door outside handle internal base is configured to be inserted and caught by is formed at the rear end portion of the third bridge between the first bridge and the second bridge.

* * * * *